US009375691B2

(12) United States Patent
Stegemoeller et al.

(10) Patent No.: US 9,375,691 B2
(45) Date of Patent: Jun. 28, 2016

(54) METHOD AND APPARATUS FOR CENTRIFUGAL BLENDING SYSTEM

(75) Inventors: Calvin Lynn Stegemoeller, Duncan, OK (US); Chad A. Heitman, Duncan, OK (US); Stanley V. Stephenson, Duncan, OK (US); Herbert John Horinek, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 90 days.

(21) Appl. No.: 13/609,460

(22) Filed: Sep. 11, 2012

(65) Prior Publication Data

US 2014/0069650 A1 Mar. 13, 2014

(51) Int. Cl.

| | |
|---|---|
| ***B01F 15/02*** | (2006.01) |
| ***E21B 43/00*** | (2006.01) |
| ***B01F 5/22*** | (2006.01) |
| ***B01F 3/12*** | (2006.01) |
| *E21B 21/06* | (2006.01) |

(52) U.S. Cl.

CPC ..... *B01F 15/0227* (2013.01); *B01F 3/1228* (2013.01); *B01F 5/22* (2013.01); *E21B 43/00* (2013.01); *B01F 2003/125* (2013.01); *E21B 21/062* (2013.01)

(58) Field of Classification Search

USPC ..... 166/305.1, 90.1, 75.12, 75.15; 366/263, 366/264, 317, 163.1, 150.1

See application file for complete search history.

(56) References Cited

U.S. PATENT DOCUMENTS 3,679,182 A * 7/1972 Clocker ..... 366/263
4,239,396 A 12/1980 Arribau et al.
4,453,829 A 6/1984 Althouse, III
4,460,276 A 7/1984 Arribau et al.
4,614,435 A 9/1986 McIntire
4,671,665 A 6/1987 McIntire
4,808,004 A 2/1989 McIntire et al.
4,850,702 A 7/1989 Arribau et al.

(Continued)

FOREIGN PATENT DOCUMENTS

EP 1648599 7/2008

OTHER PUBLICATIONS

International Search Report dated Sep. 27, 2013 for Application No. 2010-IP-033020U1PCT.

(Continued)

*Primary Examiner* — Taras P Bemko
(74) *Attorney, Agent, or Firm* — John W. Wustenberg; Baker Botts L.L.P.

(57) ABSTRACT

Blending particulate and liquid to make slurry for use in oilfield operations is addressed. The blender has an upwardly facing particulate expeller with a flat base, raised hub, and generally radially extending, circumferentially spaced vanes extending upwardly from the base. The vanes extend from leading edges spaced about a vane inner diameter to tips spaced about a vane outer diameter. Adjacent expeller vanes define expeller passageways therebetween. The particulate expeller does not serve as a meaningful liquid impeller and the blender does not act significantly as a pump. The expeller has a several preferred diameter, clearance, height and length dimensions and ratios. Wide, deep expeller inlets and shallow, narrow outlets enhance particulate entry and minimize expeller torque. Vane extensions impart velocity to the particulate upon contact and minimize sensitivity to particulate entry velocity. Maximized circumferential overlap of adjacent vanes reduces liquid back-flow.

30 Claims, 6 Drawing Sheets

(56) References Cited

U.S. PATENT DOCUMENTS

| | | | | |
|---|---|---|---|---|
| 4,915,505 | A | 4/1990 | Arribau et al. | |
| 5,904,419 | A * | 5/1999 | Arribau | 366/167.2 |
| 6,193,402 | B1 | 2/2001 | Grimland et al. | |
| 7,048,432 | B2 | 5/2006 | Phillippi et al. | |
| 7,334,937 | B2 | 2/2008 | Arribau | |
| 7,353,875 | B2 | 4/2008 | Stephenson | |
| 2004/0218463 | A1 | 11/2004 | Allen | |
| 2004/0218464 | A1 | 11/2004 | Arribau et al. | |
| 2007/0137862 | A1 * | 6/2007 | Stephenson et al. | 166/305.1 |
| 2007/0258317 | A1 | 11/2007 | Arribau et al. | |
| 2009/0268547 | A1 | 10/2009 | Pardikes | |
| 2010/0188926 | A1 * | 7/2010 | Stegemoeller et al. | 366/137 |
| 2011/0203995 | A1 * | 8/2011 | Persson et al. | 210/683 |

OTHER PUBLICATIONS

Written Opinion dated Sep. 27, 2013 for Application No. 2010-IP-033020U1PCT.

Office Action issued in related Chinese patent appln. No. 201380035563.8, issued on Oct. 28, 2015 (21 pages with translation).

* cited by examiner

METHOD AND APPARATUS FOR CENTRIFUGAL BLENDING SYSTEM

CROSS-REFERENCE TO RELATED APPLICATIONS

None

FIELD OF INVENTION

The present invention relates generally to well servicing operations, and, more particularly, to apparatus, systems and methods for mixing or blending solid or powder particulate with fluids, mixtures, and/or slurries used in well servicing operations.

BACKGROUND OF INVENTION

The present invention relates generally to well servicing operations, and, more particularly, to devices, systems and methods useful in blending fluids, mixtures, and/or slurries used in well servicing operations.

Well treatments often performed in the oil industry requiring mixing or blending of dry particulate material with a liquid or gel. Such blended materials are used in various well treatment and completion procedures. For example, well treatment fluids are utilized in fracturing formations, to increase or control hydrostatic pressure, etc. Proppant, sand, and other dry powder solids are blended with a liquid, liquid mixture or gel, to create a blended liquid having particulate entrained in the liquid. Blending to essentially homogeneous uniformity is a problem in the oil service industry, particularly for high particulate concentrations, at high blending rates, and for more viscous fluids, such as gels. Such blended fluids are typically made using a dry particulate mixed with a liquid, often water but also hydrocarbon-based and other fluids. Such blending procedures have inherent problems, particularly at remote sites or when large volumes are required. Other problems typically encountered are air entrainment in the fluid, inadequate solids wetting, and dispersion of solids. Various mixing methods have been tried with varying degrees of success.

Conventional blenders have been either the open-top tub blenders or centrifugal blenders. Open-top tub blenders and their associated short-comings, limitations and problems are discussed in U.S. Pat. No. 7,353,875 to Stephenson, issued Apr. 8, 2008, which is incorporated herein by reference for all purposes. Consequently, it is often desirable to use a centrifugal blender system.

Generally, there are three types of centrifugal blender system in use. The Condor-type blender uses an integral impeller design having a common base with both upper and lower vanes. The lower impeller vanes pump fluid into the volute chamber. The upper expeller vanes expel the sand into the volute. The suction and discharge functions are provide by a common shaft and impeller. The common shaft and impeller arrangement requires compromise in the design of the impeller and also requires sand injection occur at relatively higher discharge pressures (e.g., 60 psi or more), causing high erosion and air entrainment. Condor-type mixers are available from Condor Engineering and Manufacturing, LLC. The Crown-type blender utilizes two separate impeller-type devices driven by independent motors. A conventional suction pump having an impeller supplies fluid at required discharge pressure (e.g., 60 psi or more) to a mixing impeller, where the sand is injected into the fluid stream. The sand injection process is forced to occur at the discharge pressure (e.g., 60 psi or more), which translates to high wear and air entrainment. The three independent impeller type blender (see U.S. Pat. No. 7,353,875 to Stephenson, et al.) utilizes a suction impeller pump to supply low pressure fluid to the mixer (e.g., 10-15 psi) where the mixer expeller injects the sand into the low pressure stream. This requires relatively lower expeller speeds and thus results in lower erosion rates and reduced air entrainment. The slurry is then boosted to discharge pressure (e.g., 60 psi or more) by a third impeller in a discharge or slurry pump.

For further disclosure regarding use and structure of these blender types see U.S. Pat. No. 4,453,829 to Althouse, III; U.S. Pat. No. 4,614,435 to McIntire; U.S. Pat. No. 4,671,665 to McIntire; U.S. Pat. No. 4,808,004 to McIntire et al.; U.S. Pat. No. 4,239,396 to Arribau et al.; U.S. Pat. No. 4,460,276 to Arribau et al.; U.S. Pat. No. 4,850,702 to Arribau et al.; U.S. Pat. No. 4,915,505 to Arribau et al.; U.S. Pat. No. 6,193,402 to Grimland et al.; U.S. Pat. No. 7,334,937 to Arribau; U.S. Pat. No. 7,353,875 to Stephenson, et al.; U.S. Pat. No. 7,048,432 to Phillippi, et al., each of which is hereby incorporated herein in its entirety for all purposes.

Separating the suction pumping and/or discharge pumping from the blending process by utilizing dedicated pumps has led to advances in the art. However, problems remain with the expeller used in the blending step. Existing closed blending systems used in oil field operations consist of either large, deep impellers with vanes adapted from centrifugal pump applications, such as a "Crown" blender, now believed to be commercially available from Stewart and Stevenson as pressurized mixing chamber blenders, or specialized expeller-and-impeller designs with complicated dual mode, clean side/dirty side systems which accomplish pressure building and particulate mixing function. These designs are focused on the process of mixing proppant into a pressurized fluid container with and without an external suction pump. Other remaining problems include conveying proppant at sufficient rates, reducing introduction of air into the fluid from the action of the expeller vanes, minimizing torque requirements to spin the expeller, preventing backflow of treatment fluid into the expeller eye, and being relatively insensitive to the inlet velocity of the proppant. Consequently, there is a need for improved blending apparatus and expeller design.

SUMMARY

Apparatus and methods are presented for blending a particulate and a liquid to make slurry for use in oilfield operations. In particular, the invention relates to a blender assembly having an upwardly facing particulate expeller mounted on a rotating shaft for rotating about a rotational axis and within a blender housing. The blender housing defines a particulate inlet positioned above the particulate expeller, a liquid inlet positioned proximate a side of the housing, and a slurry outlet. The particulate expeller has a generally flat base, a raised hub central to the base, a generally flat bottom surface, and a plurality of generally radially extending, circumferentially spaced vanes extending upwardly from the base, the vanes extending from leading edges spaced about a vane inner diameter to tips spaced about a vane outer diameter. Adjacent expeller vanes define expeller passageways therebetween extending from the vane inner diameter to the vane outer diameter. Separate suction and discharge pumps may be used to pump fluid into the blender assembly and then to raise slurry pressure for pumping for use in an operation. The liquid pressure at entrance to the blender housing and the pressure of the slurry at exiting the assembly are approximately the same in a preferred embodiment, and preferably approximately 5-15 psi. The blender assembly is for imparting energy to particulate entering through the particulate inlet and wherein, in use, the liquid entering the liquid inlet is at substantially the same pressure as the slurry leaving the slurry outlet.

An expeller is presented for expelling particulate into the liquid in the blender housing. The expeller has vanes on its upper surface for accelerating the particulate. The preferred expeller does not serve as a meaningful liquid impeller, has no vanes on its lower surface, and the blender does not act significantly as a fluid pump. In preferred embodiments the expeller is designed to provide wide, deep inlets to the expeller for the particulate, shallow, narrow outlets for the particulate, vane extensions for imparting velocity to the particulate immediately upon contact with the expeller and to minimize sensitivity to particulate entry velocity, and a maximized circumferential overlap of adjacent vanes to reduce potential liquid back-flow into the expeller. In preferred embodiments, the expeller particulate passageways define inlet areas and outlet areas, wherein the ratio of the sum of the inlet areas to the sum of the outlet areas is greater than 1.0; or greater than 3.0. Preferably, each vane has a maximum height nearer the vane inner diameter than a minimum height nearer the vane tips and the ratio of vane maximum height to vane minimum height is greater than about 2.0. Preferably, the housing side wall defines a housing inner diameter and the ratio of housing inner diameter to expeller outer diameter is greater than approximately 1.5. Further, the blender assembly is preferably capable of blending approximately 200 cubic feet of particulate per minute with a liquid to form a slurry. Similarly, other capabilities and specifications are preferred, such as the expeller is capable of accelerating particulate from approximately one foot per second at the particulate inlet to approximately three feet per second at the expeller outer diameter; the expeller is capable of accelerating particulate from an inlet velocity to an outlet velocity, and wherein the ratio of inlet and outlet velocity is greater than 3.0; the vanes define exit angles of approximately 12-15 degrees; a circumferential overlap between the leading edge of a vane and a tip of an adjacent vane is designed to minimize backflow of fluid into the expeller and wherein the overlap is approximately 30 degrees. Preferably, the expeller has relatively shallow vane extensions extending radially from the hub to corresponding expeller vanes.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures. Uphole and downhole are used to indication location or direction in relation to the surface, where uphole indicates relative position or movement towards the surface along the wellbore and downhole indicates relative position or movement further away from the surface along the wellbore. Upstream and downstream are used to indicate relative position along a system flow path.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not delimit the scope of the present invention.

As used herein, the term "expeller" (and similar) is used to refer to the rotary device used to impart energy, or velocity, to a particulate as part of a blending function. The term "impeller" (or similar) is used to refer to the rotary device used to impart energy, or pressure, to a liquid. The prior art often uses the terms confusingly.

The term "particulate" as used herein refers to dry, granular material, such as powder, proppant, sand, etc., or a mixture thereof, to be entrained into a liquid to create a well treatment fluid, such as fracturing fluid, hydrostatic control fluid, etc. The term "slurry" is used herein to refer to a particulate laden liquid, a liquid-particulate mixture, for use in well treatment, such as gel entrained with sand, water entrained with proppant particulate, etc. The term slurry is used without regard to the relative viscosity or relative change in viscosity of the mixture.

Figure 1:
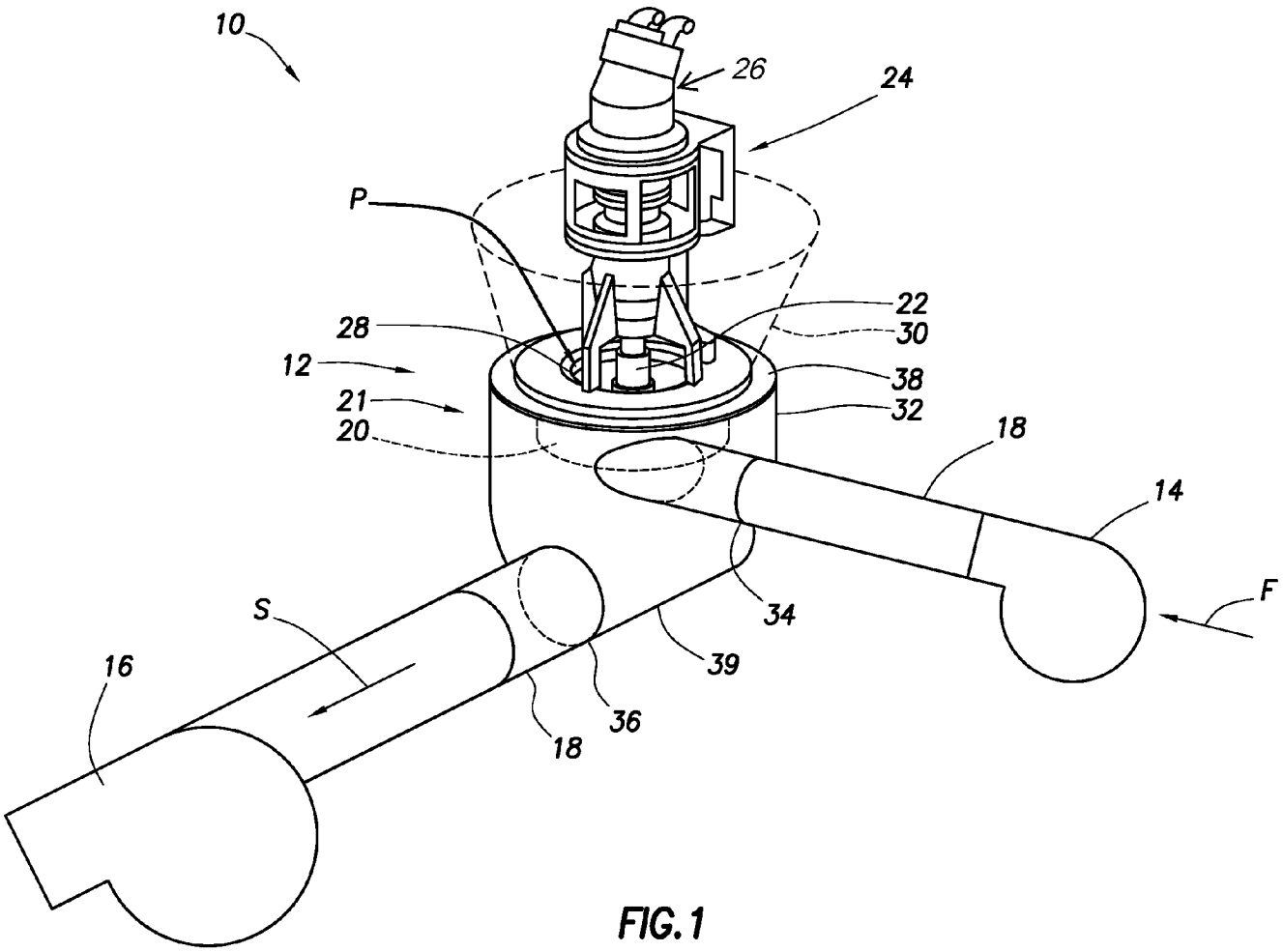
FIG. 1 is a schematic view of a blending and pumping system having a blender assembly for imparting energy to a particulate and blending the particulate with a liquid, a suction centrifugal pump for imparting energy to the liquid for delivery to the blender assembly, a discharge centrifugal pump for imparting energy to a slurry according to the present invention.

FIG. 1 is a schematic view of a typical blending and pumping system 10 having a blender assembly 12 for imparting energy to a particulate, P, and blending the particulate with a liquid, F, a suction centrifugal pump 14 for imparting energy to the liquid for delivery to the blender assembly, a discharge centrifugal pump 16 for imparting energy to a slurry, S, created in the blender assembly, and fluid conduits 18 connecting these parts of the system. In a preferred embodiment, the system 10 includes both a suction and discharge pump, as shown, however. The centrifugal pumps are common in the industry and known in the art and will not be described herein.

The blender assembly according to an aspect of the invention having a housing 21 with a expeller 20 mounted for rotation therein. Preferably the expeller 20 is attached by bolt or pin to a rotating shaft 22 powered by an attached motor 24 attached to a bearing housing 26. Particulate is input to the blender assembly at particulate inlet 28 and may be directed or fed through a hopper 30, a feed assembly having an auger, a particulate supply, etc., as is known in the art. The shaft attaches to the eye of the expeller, and creates a central hub positioned below the particulate inlet. The housing 21 is preferably a volute casing 32 having a particulate inlet 28, a liquid inlet 34, and a slurry outlet 36. The liquid inlet 34 preferably delivers incoming liquid at the approximate height of the expeller base plate 40. The slurry outlet 36 preferably extends from proximate the bottom 39 of the housing 21, as shown.

The housing includes a housing top 38 and bottom 39 as shown, connected to the volute casing wall 32. The top preferably follows the contour of the top of the expeller, defining an expeller upper clearance therebetween. The housing, in a preferred embodiment, houses about a three-barrel volume. The excess volume allows for a residual volume to permit recovery from liquid or particulate supply irregularities.

In a preferred embodiment, the suction centrifugal pump 14 imparts a relatively low pressure to the liquid of about 5-15 psi. Similarly, the slurry discharged from the blender assembly is at a relatively low pressure, such as about 5-15 psi. These relatively low pressures are due to the fact that the blender assembly does not function as a discharge pump. There may be minimal fluid pressure increase across the blender assembly since the fluid in the housing does rotate. However, the blender does not, as many prior art devices do, provide a significant increase in pressure. Prior art devices which also have a discharge pumping function typically increase the fluid pressure to in the range of 60-80 psi. The discharge centrifugal pump 16 of the invention performs the pressure increase function to the slurry after blending has occurred in the housing and increases fluid pressure to relatively high pressures of, for example, about 60 to 80 psi.

Figure 2:
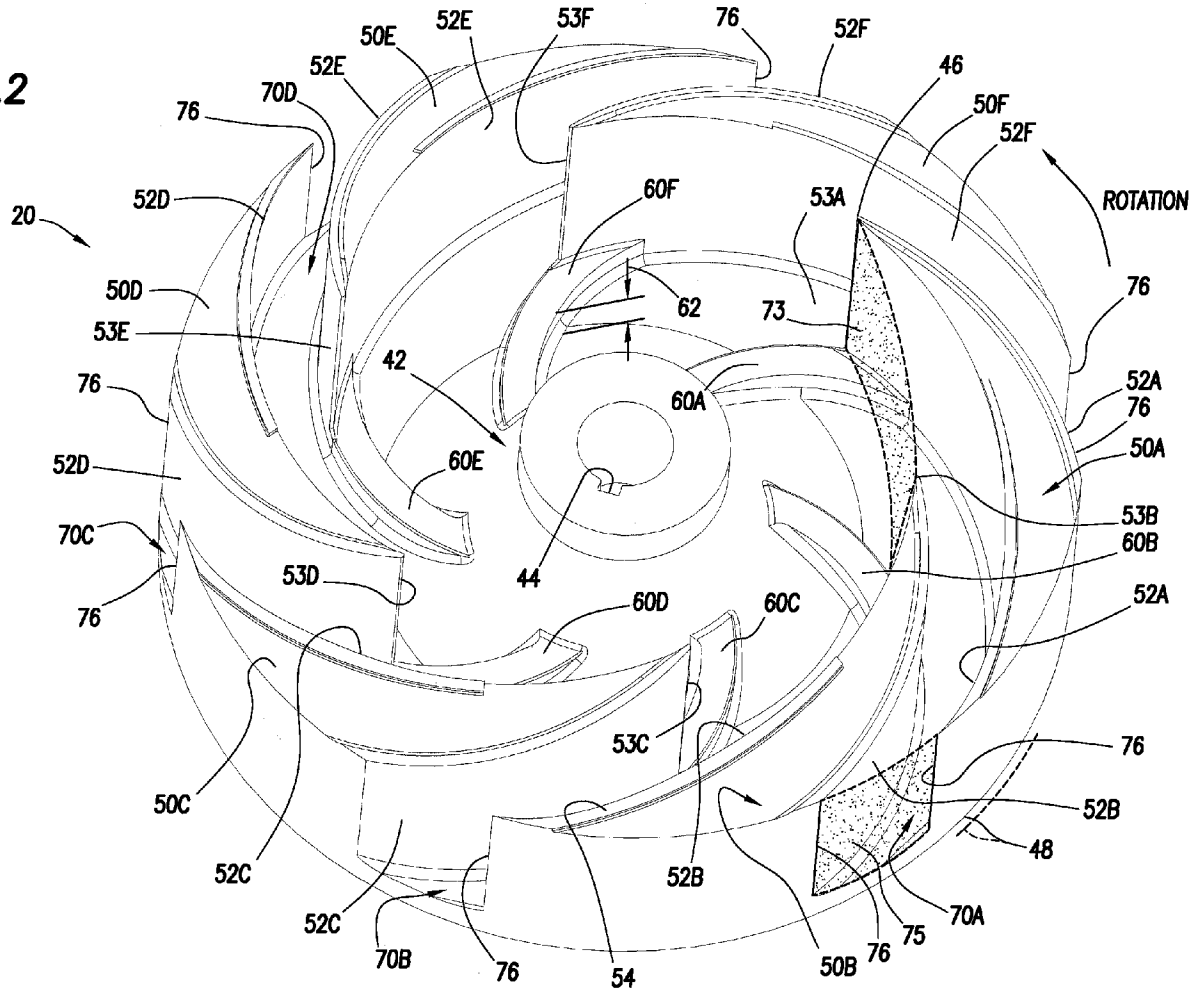
FIG. 2 is an orthogonal view of an exemplary expeller for use in the blender assembly according to an aspect of the invention.
Figure 3:
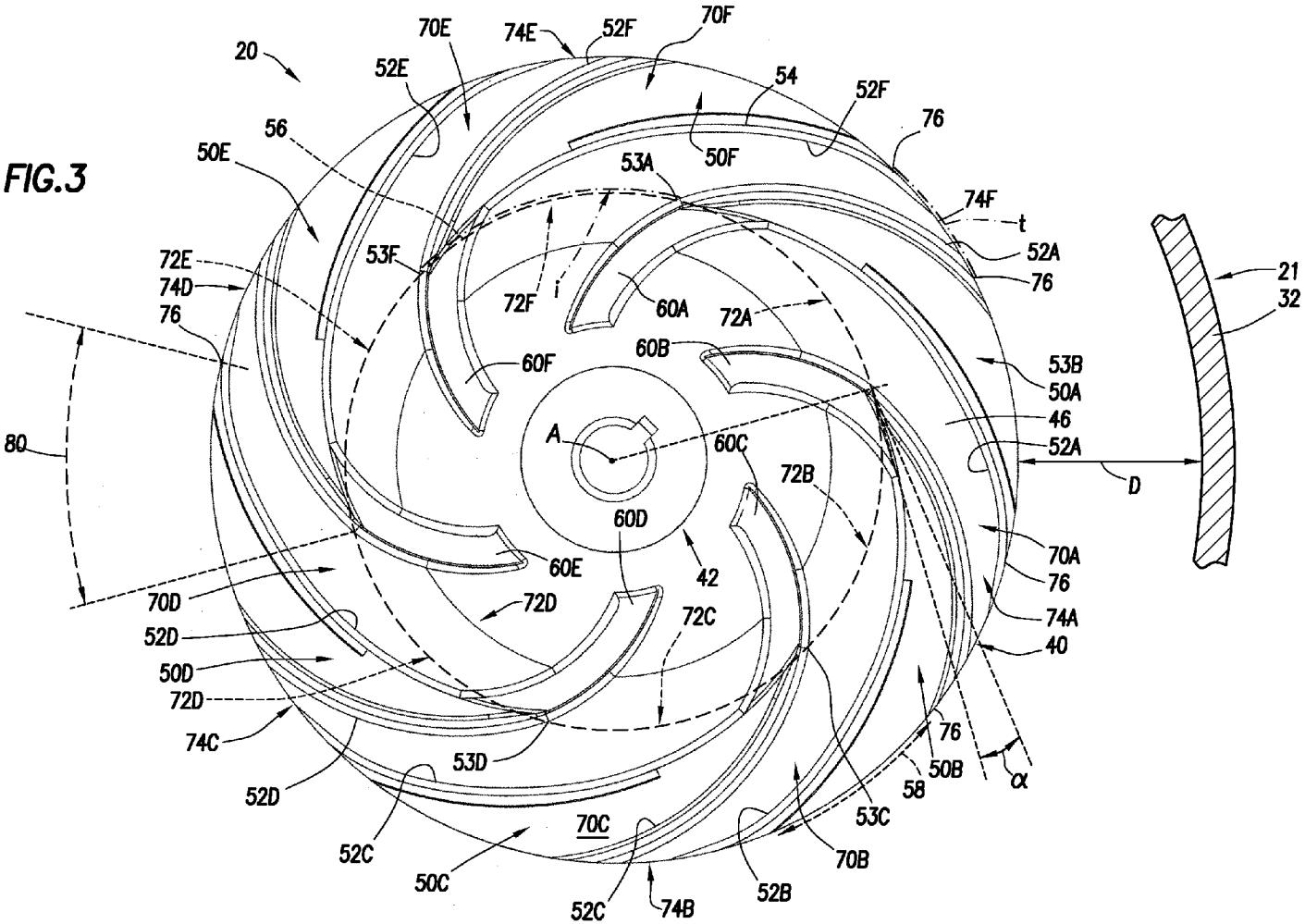
FIG. 3 is a top view in partial cross-section of the exemplary expeller of FIG. 2.
Figure 4:
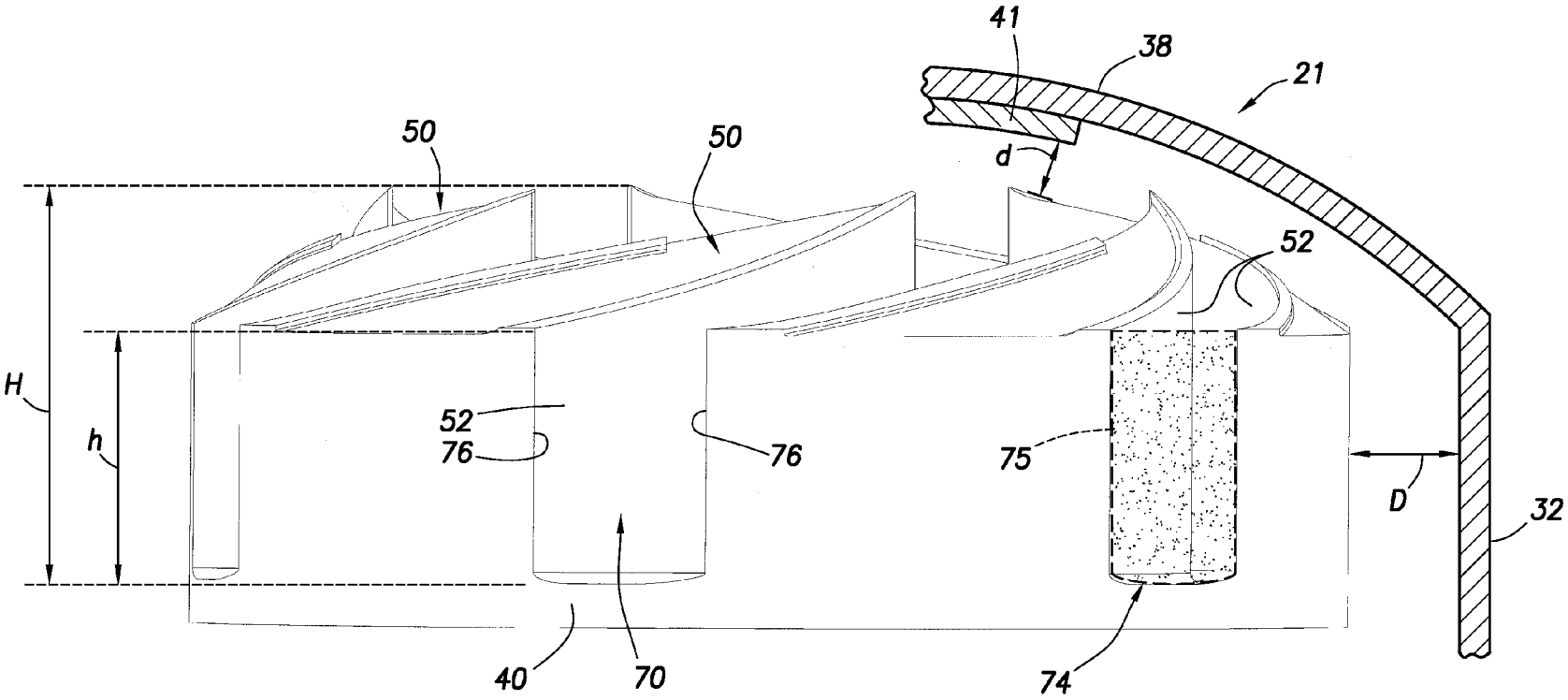
FIG. 4 is a side elevational view with partial cross-section of the exemplary expeller of FIGS. 2 and 3.
Figure 5:
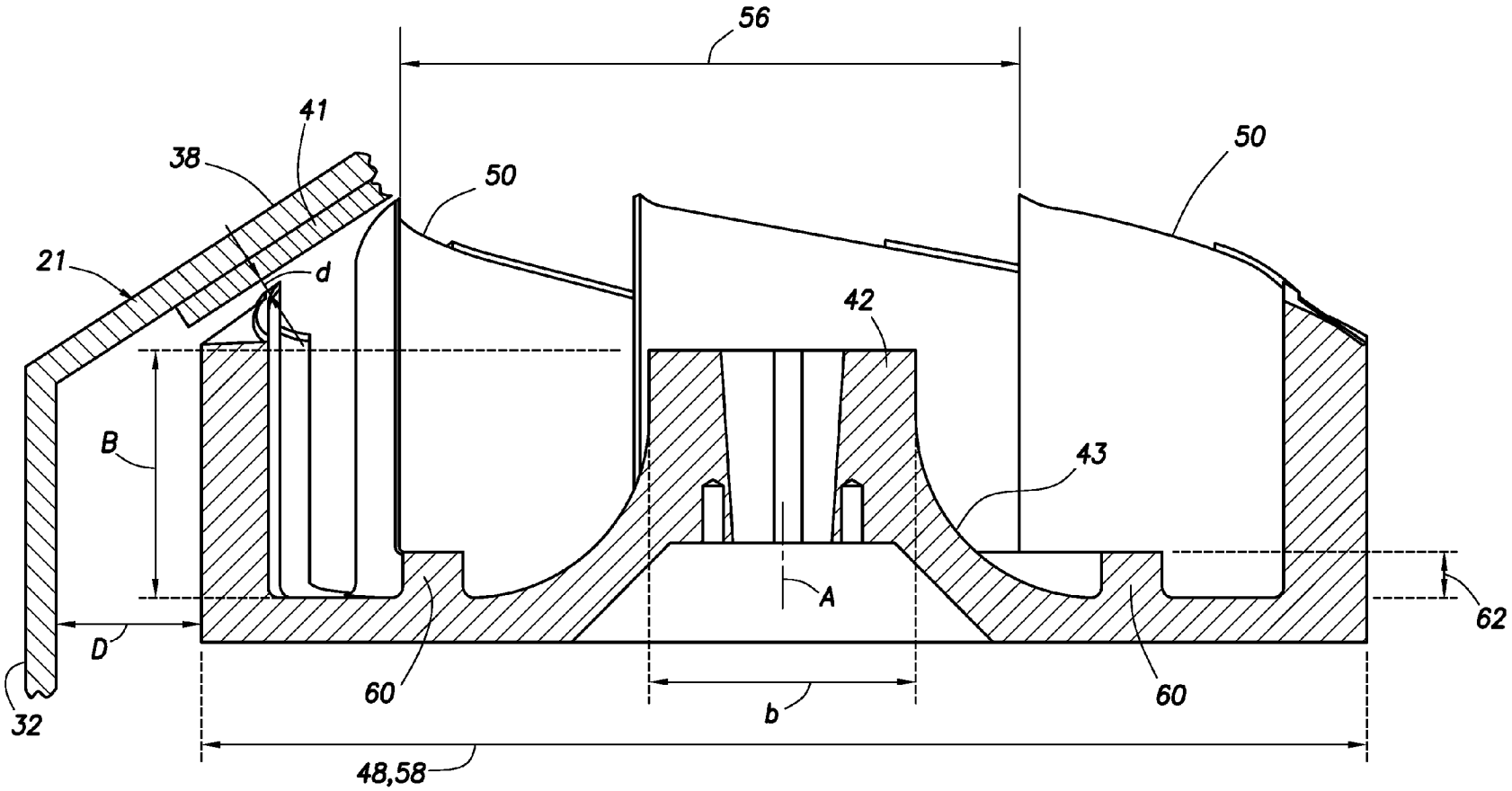
FIG. 5 is an elevational, cross-sectional view of the exemplary expeller of FIGS. 2 through 4.

FIG. 2 is an orthogonal view of an exemplary expeller 20 for use in the blender assembly 12 according to an aspect of the invention. FIG. 3 is a top view of the exemplary expeller of FIG. 2. FIG. 4 is a side elevational view of the exemplary expeller of FIGS. 2 and 3. FIG. 5 is an elevational, cross-sectional view of the exemplary expeller. The expeller 20 has a base plate 40 which defines a substantially flat annular area and an upwardly extending, central, arcuate or conical hub 42 having a hub diameter, b, extending a hub height, B, above the base plate. The hub has an external arcuate or conical surface or wall 43. The hub rotates about a center or axis of rotation, A. The hub 42 includes a connecting mechanism 44 for releasable attachment to a power shaft, for example. The expeller 20 is mounted for rotation within the blender assembly housing 21. The base plate 40 has an upper surface 46 and defines a base plate outer diameter (OD) 48.

The exemplary expeller has six vanes 50A-F extending from the base plate 40. The vanes 50 generally are radially extending, circumferentially spaced vanes extending upwardly from the upper surface 46 of the base plate 40. The expeller rotates in the direction indicated by the arrow. Other embodiments may have different numbers of vanes. Each vane 50 has two arcuate, substantially vertical surfaces 52*a-f* which diverge as the base plate diameter increases. The space defined between the vane surfaces 52 of any one vane is solid or enclosed to prevent liquid or particulate from entry into the space. The vane surfaces 52 are subject to wear by the particulate and preferably made of or have mounted thereon a hardened material 54. The hardened material 54 may be attached as plates or be integral to the expeller and are not required to extend the entire area of the vane surfaces 52. The leading edge 53 of each vane 50 preferably forms a substantially vertical line, at the convergence of vane surfaces 52. For example, the vane 50A has surfaces 52*a* which converge at the vane ID to a vertical line 53*a*, etc. In the preferred embodiment, wherein the leading edge of the vane defines a vertical line, there is virtually no inward facing vane surface which would be subject to extensive wear. The virtual cylinder intersecting with these lines defines a vane inner diameter (ID) 56. This demarcation is also referred to as the expeller "mouth" or "eye."

The vanes extend radially outwardly from the hub a distance to define a vane OD 58, preferably coincident with the base plate OD. The vanes extend upwardly a vane height, as best seen in FIG. 4. In a preferred embodiment, the vanes vary in height along their radial lengths, reducing in height as the vanes approach the OD of the base plate. As best seen in FIG. 4, each vane has a minimum height, h, preferably at the vane OD (and plate OD), and a maximum height, H, preferably proximate the vane ID. In a preferred embodiment, the minimum height is approximately six inches while the maximum height is approximately 9 inches. In other embodiments, the exemplary vanes may be of uniform height along their radial extents. Further, an axial clearance distance, d, is defined between a wear ring 41 attached to the housing top 38 and the upper surfaces of the expeller. The clearance distance, d, is preferably relatively small, such as between 0.03 inches and 0.10 inches. Clearance distances not to scale.

In a preferred embodiment, the expeller design also includes shallow vane extensions 60A-F, extending radially across the expeller mouth, between the vane ID 56 and the hub 42 at the center of rotation of the base plate 40. The vane extensions 60 are relatively shallow to allow the low velocity particulate to fill the space between adjacent vane extensions and induce radial and tangential velocity to the particulate as it impacts the base plate of the expeller. The vane extensions 60 extend upwardly an extension height 62, which is preferably greater nearer the OD of the expeller mouth and reduced (even to zero) nearer the arcuate surface of the hub.

The inner surface of the cylindrical wall 32 of the housing 21 is spaced apart from the base plate OD by a radial clearance distance, D. Since the blending assembly operates at a relatively low pressure, the housing wall is not positioned at a tight tolerance to the expeller OD as on systems wherein the blender assembly must both mix and impart fluid pressure.

Generally, the vanes are designed to define deep and wide vane passageway inlets to enhance particulate entry to the passageways between the vanes, to maximize the "overlap" of vanes at the OD to reduce potential liquid back-flow, to define a narrow and shallow vane outlet openings at the OD to minimize torque requirements, and to have shallow vane extensions between the hub and vane ID to minimize sensitivity to particulate entry velocity and to impart velocity to the particulate quickly upon impact with the expeller.

The expeller vanes convey particulate, entering the housing 21 through particulate inlet 28 into the expeller mouth, away from the center of rotation of the expeller to the OD of the expeller, where it is thrown into and mixed with the treatment liquid, which has entered the housing 21 through the liquid inlet 34, at a relatively low pressure (on the order of 5 to 15 psi) in the housing to form a slurry. The slurry then flows out of the blender assembly and to a dedicated discharge pump to build pressure (on the order of 60 to 70 psi). The expeller design is preferably optimized to convey particulate at sufficient rates, introduce minimum air into the fluid from the action of the vanes, minimize torque requirements to rotate the expeller, prevent backflow of treatment fluid into the expeller eye and be relatively insensitive to the inlet velocity of the particulate.

Between adjacent vanes 50, expeller passageways 70A-F are defined, extending from the expeller mouth 56 to the vane plate OD 58. For example, expeller passageway 70A is defined between the adjacent vanes 50A and 50B. Each passageway 70A-F has a corresponding inlet 72*a-f* and outlet 74*a-f*. The passageway inlet 72 has an inlet area 73 defined by the distance, i, between adjacent vanes at the expeller mouth (vane ID) multiplied by the vane height, H, at the vane ID. Similarly, each passageway 70 has a corresponding passageway outlet 74 with an outlet area 75 defined by the distance, t, between adjacent vane tips 76 at the expeller OD multiplied by the vane height, h, at that location. Total inlet and total outlet areas are computed by adding together the individual inlet and outlet areas, respectively.

The expeller passageway outlet area is preferably minimized. Resistive torque on the expeller is created by, and dependent on the size of, the expeller passageway outlets. The relatively smaller outlet area minimizes torque on the drive shaft and motor and minimizes the horsepower necessary to operate the blender assembly. The expeller passageway inlets are preferably maximized, as the inlet area limits particulate flow rate into and through the passageways. In a preferred embodiment, the total inlet area to total outlet area ratio is greater than one.

Adjacent vanes 50 define an overlap 80 between the leading edge of a vane, at the vane ID, and the vane tip 76 at the vane OD of an adjacent vane, as shown in FIG. 3. The overlap 80 is preferably maximized to reduce or eliminate backflow into the expeller mouth, especially upon shut-off. In a preferred embodiment, the overlap is 30 degrees.

Each vane 50 also defines an exit angle $\alpha$ as seen in FIG. 3. A larger exit angle typically results in better performance, since the particulate will better "slide off" the expeller. In a preferred embodiment, the exit angle is at least twelve degrees. In another preferred embodiment, the exit angle is between about 12 and 15 degrees. The exit angle $\alpha$ is the angle of the concave side of the vane at the leading edge of the vane with respect to a line tangential to the circle defined by the vane IDs at the same point. The exit angle $\alpha$ is measured as the angle between 1) a line tangential to the concave surface of the vane at the leading edge (or vane ID), and 2) a line tangent to a radial line extending from the center of rotation of the expeller to the leading edge of the vane (or concave side of the leading edge).

Turning to an exemplary six-vane blender system, critical dimensions and parameters are provided, wherein the dimensions and parameters are approximate. Other dimensions and parameters may be used. The hub has a six inch diameter. The mouth or vane ID is 17 inches. The expeller OD is 26 inches. The housing wall has a diameter of 40 inches, making the OD clearance 14 inches. The expeller total inlet area is approximately three times the expeller total outlet area. For example, the expeller passageway vane ID is 17 inches and the vane height at the mouth is nine inches, making the total inlet area 480 square inches. The expeller passageway outlets provide a four inch gap between adjacent vane surfaces and a vane height at the OD of six inches, making the total outlet area of the six outlets 144 square inches, or approximately one-third of the inlet area. The particulate velocity through the inlet area is a maximum of one foot per second, with a centrifugal force of 85G. The particulate inlet flow rate is 5760 cubic inches per second (480 square inches inlet area at 12 inches per second inlet velocity), or 345,600 cubic inches or 200 cubic feet per minute. This is 200 standard sacks of sand per minute. The outlet velocity is 3.3 feet per second. The shallow vane extensions are preferably kept to a minimum height to allow time for free falling particulate to fill spaces between the extensions. At one foot of free fall, the maximum sand velocity is 8 feet per second at 0.0167 seconds between vanes for an extension height of about 1.6 inches. Computational Fluid Dynamic analysis indicates that the shallow vane extensions entrain less air into the blending assembly.

Additional benefits of the system include a low wear potential in the expeller and housing due to relatively lower velocity of the abrasive slurry, a blending system having no seals (mechanical sealing on expeller shaft) (centrifugal seal only), and the particulate handling capacity is not dependent on the particulate inlet velocity.

Figure 6:
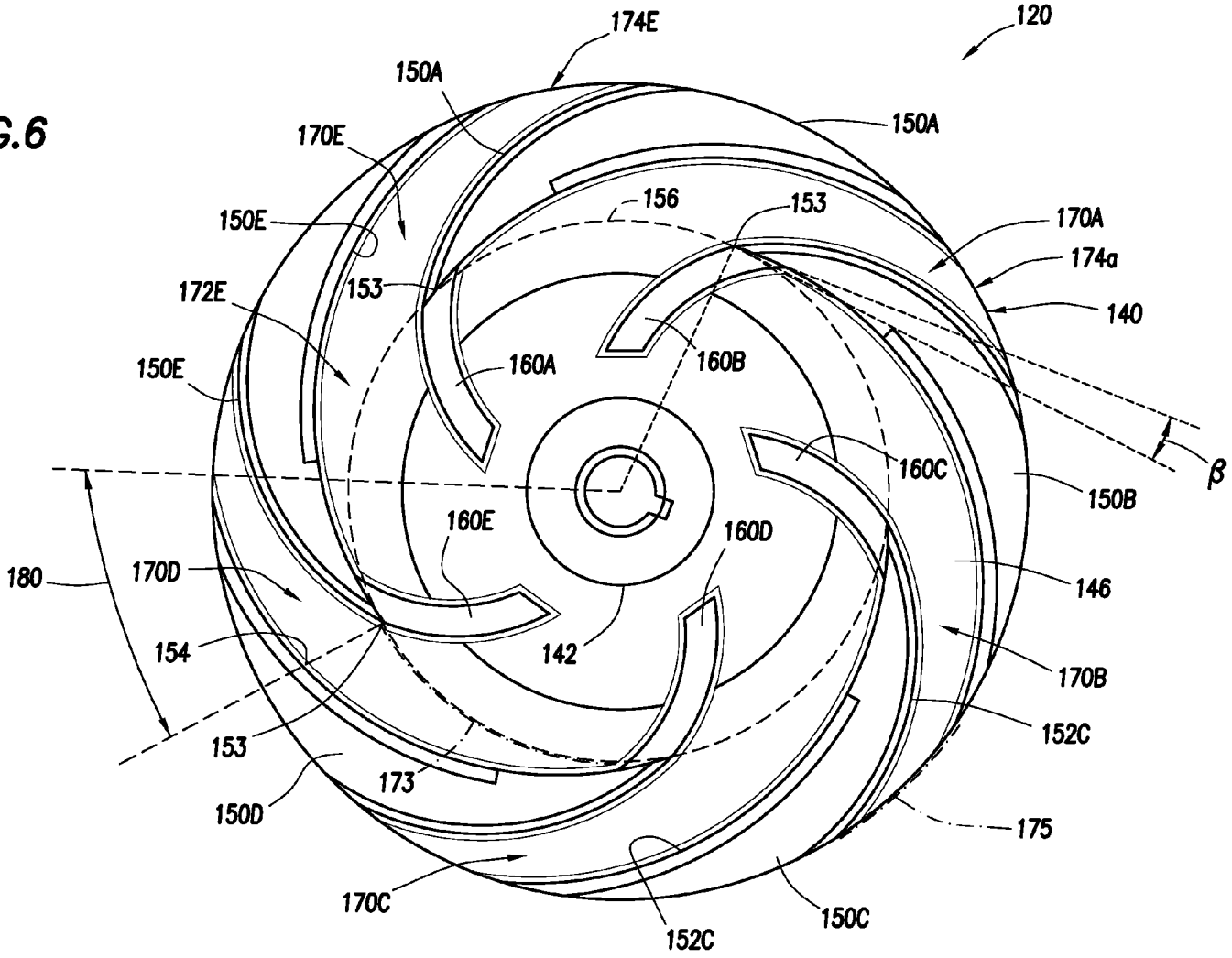
FIG. 6 is a top view of an alternative embodiment of an expeller according to an aspect of the invention.

FIG. 6 is a top view of an alternate expeller according to an aspect of the invention. The expeller seen in FIG. 6 is similar to that described above, however, this embodiment has five vanes rather than six. Practitioners will recognize the advantages and disadvantages of vane numbers. Since the six-vane expeller is described in great detail above, the discussion of the five-vane embodiment will be brief and not discuss each expeller element, measurement, etc.

The exemplary expeller 120 has five vanes 150A-E extending upwardly from a face 146 of a base plate 140. Each vane 150 has two arcuate, substantially vertical surfaces 152*a-f* which diverge as the base plate diameter increases. A hardened material 154 is seen on the vanes to protect against wear. The leading edge 153 of each vane 150 preferably forms a substantially vertical line, at the convergence of vane surfaces. The virtual cylinder intersecting with the leading edges defines a vane inner diameter (ID) 156, or mouth.

The vanes extend radially outwardly from a raised hub 142 and define a vane OD, preferably coincident with the base plate OD. In a preferred embodiment, the expeller design also includes shallow vane extensions 160A-E, extending radially across the expeller mouth. The vane extensions 160 are relatively shallow to allow the low velocity particulate to fill the space between adjacent vane extensions and induce radial and tangential velocity to the particulate as it impacts the base plate of the expeller.

The expeller vanes convey particulate, entering the housing through a particulate inlet into the expeller mouth, away from the center of rotation of the expeller to the OD of the expeller, where it is thrown into and mixed with the treatment liquid, which has entered the housing through a liquid inlet at a relatively low pressure (on the order of 5 to 15 psi) in the housing to form a slurry. The slurry then flows out of the blender assembly and to a dedicated discharge pump to build pressure (on the order of 60 to 70 psi). The expeller design is preferably optimized to convey particulate at sufficient rates, introduce minimum air into the fluid from the action of the vanes, minimize torque requirements to rotate the expeller, prevent backflow of treatment fluid into the expeller eye and be relatively insensitive to the inlet velocity of the particulate.

Between adjacent vanes 150, expeller passageways 170A-E are defined, extending from the expeller mouth to the vane plate OD. Each passageway 170A-E has a corresponding inlet 172A-E and outlet 174A-E. The passageway inlet 172 defines an inlet area 173. Similarly, each passageway 170 has a corresponding passageway outlet 174 defining an outlet area 175. Total inlet and total outlet areas are computed by adding together the individual inlet and outlet areas, respectively. Not all parts are marked in FIG. 6 and the areas are seen from above as dashed arcs with the corresponding heights not seen. For reference, refer to FIGS. 2-5 for corresponding parts and areas.

The expeller passageway outlet area is preferably minimized. Resistive torque on the expeller is created by, and dependent on the size of, the expeller passageway outlets. The relatively smaller outlet area minimizes torque on the drive shaft and motor and minimizes the horsepower necessary to operate the blender assembly. The expeller passageway inlets are preferably maximized, as the inlet area limits particulate flow rate into and through the passageways.

Adjacent vanes 150 define an overlap 180 between the leading edge of a vane, at the vane ID, and the vane tip 76 at the vane OD of an adjacent vane, as shown in FIG. 3. The overlap 80 is preferably maximized to reduce or eliminate backflow into the expeller mouth, especially upon shut-off. In a preferred embodiment, the overlap is 30 degrees. In a preferred embodiment, the inlet to overlap ratio is greater than one. Each vane 150 also defines an exit angle β.

In use, the assembly and system is used to blend or mix particulate with liquid for use in an oilfield application or operation. Exemplary methods and steps of methods are listed here; not all of the steps are necessary, the steps are not necessarily presented in sequence; the claims define the invention: a method for blending particulate material and liquid to create a slurry for use in oilfield operations, the method comprising the steps of: providing a liquid to a blender assembly; providing a particulate to the blender assembly; blending the particulate and the liquid to create a slurry using the blender assembly, the blender assembly for expelling particulate into the liquid and having an expeller mounted for rotation in a blender housing, the expeller having a plurality of generally radially extending, circumferentially spaced vanes, each vane extending upwardly from a circular base plate, the vanes extending from a vane inner diameter to a vane outer diameter, a plurality of expeller passageways defined between adjacent vanes; discharging the slurry from the blender assembly; using the slurry in an oilfield operation; a method wherein the step of providing a liquid to the blender assembly further comprises the step of providing the liquid at a first pressure; wherein the step of discharging the slurry from the blender assembly further comprises the step of discharging the slurry at a second pressure; and wherein the first and second pressures are in the range of 5-15 psi; a method wherein each expeller passageway defines an inlet area and an outlet area, and wherein the ratio of inlet to outlet area is greater than 1.0; a method wherein the ratio of inlet to outlet area is greater than 2.5; a method wherein the step of providing a liquid further comprises the step of pumping the liquid into the blender assembly; a method discharging the slurry from the blender assembly further comprises pumping the slurry using a discharge pump fluidly connected to the blender assembly; a method wherein the step of pumping the slurry using a discharge pump further comprises the step of increasing the pressure in the slurry, after the slurry exits the blender assembly, to approximately 60-80 psi; a method wherein each vane has a maximum height nearer the vane inner diameter than a minimum height nearer the vane tips, and wherein the ratio of vane maximum height to vane minimum height is greater than about 2.0; a method wherein the blender assembly has a housing side wall defining a housing inner diameter, the side wall spaced radially from an outer diameter of the expeller, and wherein the ratio of housing inner diameter to expeller outer diameter is greater than approximately 1.5; a method further comprising the step of blending approximately 200 cubic feet of particulate per minute with liquid to form slurry; a method further comprising the step of accelerating particulate from approximately one foot per second to approximately three feet per second near the expeller outer diameter; a method further comprising the step of accelerating particulate from an inlet velocity to an outlet velocity, and wherein the ratio of inlet and outlet velocity is greater than 3.0.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. Illustrative embodiments of the present invention are described in detail below. In the interest of clarity, not all features of an actual implementation are described in this specification. In the development of any commercial or physical embodiment, numerous implementation-specific decisions must be made to achieve a developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure. It is, therefore, intended that the appended claims encompass any such modifications or embodiments.

What is claimed is:

1. A blender system for blending particulate material with a liquid to create a slurry for use in oilfield operations, the system comprising:

a blender assembly having:

an upwardly facing particulate expeller mounted on a rotating shaft for rotating about a rotational axis and within a blender housing;

the blender housing defining a particulate inlet positioned above the particulate expeller, a liquid inlet positioned proximate a side of the housing, and a slurry outlet, the particulate expeller having a generally flat base, a raised hub central to the base, and a plurality of generally radially extending, circumferentially spaced vanes extending upwardly from the base, the vanes extending from leading edges spaced about a vane inner diameter to tips spaced about a vane outer diameter, wherein each vane has a maximum height nearer to the vane inner diameter a different minimum height nearer to the vane outer diameter, and wherein the generally flat base includes a generally flat bottom surface having no vanes extending downwardly therefrom; and wherein adjacent expeller vanes define expeller passageways therebetween extending from the vane inner diameter to the vane outer diameter.

2. The system as in claim 1, further comprising a suction pump fluidly connected to the liquid inlet of the blender assembly, the suction pump for imparting energy to a liquid.

3. The system as in claim 2, wherein the suction pump is for imparting a pressure of approximately 5-15 psi to the liquid.

4. The system as in claim 2, further comprising a discharge pump fluidly connected to the slurry outlet of the blender assembly, the discharge pump for imparting energy to a liquid, the discharge pump for imparting a relatively high pressure to the slurry.

5. The system as in claim 4, wherein the discharge pump is for imparting a discharge pressure to the slurry of approximately 60-80 psi.

6. The system as in claim 1, wherein the blender assembly is for imparting energy to particulate entering through the particulate inlet and for wherein, in use, the liquid entering the liquid inlet is at substantially the same pressure as the slurry leaving the slurry outlet.

7. The system as in claim 6, wherein the blender assembly is operable to receive liquid at approximately 5-15 psi and to discharge slurry at approximately 5-15 psi.

8. The system as in claim 1, wherein the expeller passageways have passageway inlets and passageway outlets, each passageway inlet defining an inlet area, and each passageway outlet defining an outlet area, and wherein the ratio of the sum of the inlet areas to the sum of the outlet areas is greater than 1.0.

9. The system as in claim 8, wherein the ratio of the sum of the inlet areas to the sum of the outlet areas is approximately 3.0.

10. The system as in claim 1, wherein the ratio of vane maximum height to vane minimum height is greater than about 2.0.

11. The system as in claim 1, wherein the housing has a side wall defining a housing inner diameter, the side wall spaced radially from the outer diameter of the expeller, and wherein the ratio of housing inner diameter to expeller outer diameter is greater than approximately 1.5.

12. The system as in claim 1, wherein the blender assembly is capable of blending approximately 200 cubic feet of particulate per minute with a liquid to form a slurry.

13. The system as in claim 1, wherein the expeller is capable of accelerating particulate from approximately one foot per second at the particulate inlet to approximately three feet per second at the expeller outer diameter.

14. The system as in claim 1, wherein the expeller is capable of accelerating particulate from an inlet velocity to an outlet velocity, and wherein the ratio of inlet and outlet velocity is greater than 3.0.

15. The system as in claim 1, wherein the vanes define exit angles of approximately 12-15 degrees.

16. The system as in claim 1, wherein the leading edge of a vane and a tip of an adjacent vane defines a circumferential vane overlap designed to minimize backflow of fluid into the expeller.

17. The system as in claim 16, wherein the overlap is approximately 30 degrees.

18. The system as in claim 1, wherein the expeller further has a plurality of relatively shallow vane extensions extending generally radially from the hub to corresponding expeller vanes.

19. A method for blending particulate material and liquid to create a slurry for use in oilfield operations, the method comprising the steps of:

providing a liquid to a blender assembly;

providing a particulate to the blender assembly;

blending the particulate and the liquid to create a slurry using the blender assembly, the blender assembly for expelling particulate into the liquid and having an expeller mounted for rotation in a blender housing, the expeller having a plurality of generally radially extending, circumferentially spaced vanes, all vanes of the expeller extending upwardly from a circular base plate having a substantially flat bottom surface without downwardly extending vanes, the vanes extending from a vane inner diameter to a vane outer diameter, wherein each vane has a maximum height nearer to the vane inner diameter a different minimum height nearer to the vane outer diameter, and, a plurality of expeller passageways defined between adjacent vanes;

discharging the slurry from the blender assembly;

using the slurry in an oilfield operation.

20. The method as in claim 19, wherein the step of providing a liquid to the blender assembly further comprises the step of providing the liquid at a first pressure;

wherein the step of discharging the slurry from the blender assembly further comprises the step of discharging the slurry at a second pressure; and wherein the first and second pressures are in the range of 5-15 psi.

21. The method as in claim 19, wherein each expeller passageway defines an inlet area and an outlet area, and wherein the ratio of inlet to outlet area is greater than 1.0.

22. The method as in claim 21, wherein the ratio is greater than 2.5.

23. The method as in claim 19, wherein the step of providing a liquid further comprises the step of pumping the liquid into the blender assembly.

24. The method as in claim 19, wherein the step of discharging the slurry from the blender assembly further comprises pumping the slurry using a discharge pump fluidly connected to the blender assembly.

25. The method as in claim 24, wherein the step of pumping the slurry using a discharge pump further comprises the step of increasing the pressure in the slurry, after the slurry exits the blender assembly, to approximately 60-80 psi.

26. The method as in claim 19, wherein the ratio of vane maximum height to vane minimum height is greater than about 2.0.

27. The method as in claim 19, wherein the blender assembly has a housing side wall defining a housing inner diameter, the side wall spaced radially from an outer diameter of the expeller, and wherein the ratio of housing inner diameter to expeller outer diameter is greater than approximately 1.5.

28. The method as in claim 19, further comprising the step of blending approximately 200 cubic feet of particulate per minute with liquid to form slurry.

29. The method as in claim 19, further comprising the step of accelerating particulate from approximately one foot per second to approximately three feet per second near the expeller outer diameter.

30. The method as in claim 19, further comprising the step of accelerating particulate from an inlet velocity to an outlet velocity, and wherein the ratio of inlet and outlet velocity is greater than 3.0.

* * * * *